US012320355B2

(12) United States Patent
Rossi

(10) Patent No.: US 12,320,355 B2
(45) **Date of Patent: *Jun. 3, 2025**

(54) SCREW ASSEMBLY FOR A TRIPLE SCREW PUMP AND SCREW PUMP COMPRISING SAID ASSEMBLY

(71) Applicant: SETTIMA MECCANICA S.R.L., Milan (IT)

(72) Inventor: Manuele Rossi, Ponte dell'Olio (IT)

(73) Assignee: Settima Meccanica S.r.l., Milan (IT)

( * ) Notice: Subject to any disclaimer, the term of this patent is extended or adjusted under 35 U.S.C. 154(b) by 0 days.

This patent is subject to a terminal disclaimer.

(21) Appl. No.: 18/547,472

(22) PCT Filed: Dec. 28, 2021

(86) PCT No.: PCT/EP2021/087709
§ 371 (c)(1),
(2) Date: Aug. 22, 2023

(87) PCT Pub. No.: WO2022/179745
PCT Pub. Date: Sep. 1, 2022

(65) Prior Publication Data

US 2024/0318649 A1 Sep. 26, 2024

(30) Foreign Application Priority Data

Feb. 23, 2021 (IT) ..... 102021000004139

(51) Int. Cl.
*F04C 2/16* (2006.01)
*F04C 2/08* (2006.01)

(52) U.S. Cl.
CPC ..... *F04C 2/165* (2013.01); *F04C 2/084* (2013.01); *F04C 2250/20* (2013.01)

(58) Field of Classification Search
CPC ..... F04C 2/165; F04C 2/084; F04C 2250/20
See application file for complete search history.

(56) References Cited

U.S. PATENT DOCUMENTS 630,648 A * 8/1899 Brewer ..... F04C 2/165 418/197
2,079,083 A * 5/1937 Montelius ..... G01F 3/10 73/261

(Continued)

FOREIGN PATENT DOCUMENTS

EP 0209984 A1 1/1987

OTHER PUBLICATIONS

International Search Report dated May 2, 2022, issued in connection with PCT/EP2021/087709.

(Continued)

*Primary Examiner* — Mary A Davis
(74) *Attorney, Agent, or Firm* — Akerman LLP

(57) ABSTRACT

Screw assembly (1) for a triple screw pump (10), comprising: a central screw (2) and at least one lateral screw (3) configured to mesh with said central screw (2) with a lateral screw axis ($z_l$) parallel to the central screw axis ($z_c$), wherein a central screw external diameter ($Ø_{ce}$) is greater than a lateral screw external diameter ($Ø_{le}$) and a central screw internal diameter (0ci) is smaller than the lateral screw external diameter ($Ø_{le}$).

15 Claims, 9 Drawing Sheets

(56) References Cited

U.S. PATENT DOCUMENTS

| | | | | |
|---|---|---|---|---|
| 2,481,527 | A | 9/1949 | Nilsson | |
| 2,652,192 | A * | 9/1953 | Chilton | F01C 1/165 418/150 |
| 3,814,557 | A | 6/1974 | Volz | |
| 7,008,201 | B2 * | 3/2006 | Heizer | F04C 18/084 418/104 |
| 8,282,371 | B2 * | 10/2012 | Hashida | F04C 2/165 418/201.3 |
| 2012/0258000 | A1 | 10/2012 | Patton | |
| 2024/0125322 | A1 * | 4/2024 | Rossi | F04C 2/084 |

OTHER PUBLICATIONS

Written Opinion of the International Searching Authority dated May 2, 2022, issued in connection with PCT/EP2021/087709.

* cited by examiner

PRIOR ART

SCREW ASSEMBLY FOR A TRIPLE SCREW PUMP AND SCREW PUMP COMPRISING SAID ASSEMBLY

CROSS-REFERENCE TO RELATED APPLICATIONS

This application is a national phase of PCT/EP2021/087709, filed Dec. 28, 2021, and claims priority to Italian Patent Application No. 102021000004139, filed Feb. 23, 2021, the entire contents of both of which are hereby incorporated by reference.

FIELD OF APPLICATION

The present invention relates to a screw assembly for a volumetric gear pump, in particular for a triple screw pump. The invention also relates to a triple screw pump comprising the above screw assembly.

The invention finds useful application in the various industrial fields in which gear pumps, and in particular triple screw pumps, are traditionally used.

A typical field of use in which triple screw pumps are appreciated is that of the lifting systems, but they are also widely used in other fields for various applications: power hydraulics, lubrication, cooling, filtration, transfer. By way of non-limiting example, other industrial fields in which the triple screw pump is applied, in addition to that of the lifting systems, include oil &, gas, chemical, naval, mobile, agri-food, power generation and alternative energy, paper industry, pharmaceutical industry.

PRIOR ART

The triple screw pump, designed by the Swedish engineer Carl Montelius in 1923, is a volumetric pump nowadays widely used in various industrial fields. In fact, it has remarkable overall efficiency, good reliability, reasonable price, low level of acoustic emissions and vibrations in the flow transmission.

The triple screw pump has a set of three screws, a central lead one and two lateral driven screws. The screws, preferably with two helicoidal threads, are mounted in parallel within a casing and mesh with each other, thus generating closed volumes between their body and the casing. The closed chambers that are thus formed are in a number that is directly proportional to the length of the screws—also called rotors—and inversely proportional to the pitch of the helicoidal threads. The closed chambers are occupied by the working fluid which, during the rotation of the screws, continuously moves forward from a suction port to a discharge port.

The profile of the set of three screws is designed so that only the drive screw delivers pressure. This screw, given the configuration of the pump, is not exposed to radial forces and thus gives the machine the good overall efficiency previously mentioned. As previously stated, the two driven screws are idle and guided by the pressurized fluid. The sole hindrances to their rotation are the viscous friction with the working fluid and the sliding friction with the central screw and with the casing within which they are contained. For this reason, wear of the screws flanks is almost null even after prolonged periods of work.

Almost a century after its birth, the triple screw pump still shows the characteristic appearance conceived by its creator, characterized by a typical ratio between the diameters of the front profiles of the central lead screw and of the lateral driven screws. Indicating $Ø_{li}$ and $Ø_{le}$ the lateral screw internal and external diameters, respectively, and $Ø_{ci}$ and $Ø_{c}$ the central screw internal and external diameters, respectively, the dimensions $Ø_{li}:Ø_{le}:Ø_{ci}:Ø_{ce}$ in fact follow the ratio 1:3:3:5, which is considered optimal since it would present the best possible ratio between the area occupied by the fluid and the solid area defined by the material of the screws.

In this ratio, it is noted that the lateral screw external diameter $Ø_{le}$ and the central screw internal diameter $Ø_{ci}$ are always strictly the same. The equality between these diameters is considered in the prior art as an absolute axiom, which the design of any triple screw pump is based on.

The circles identified by the aforementioned diameters represent the pitch diameters used to create the curves that constitute the ideal profiles—that is, the profiles before the changes generally adopted to eliminate sharp edges. The consideration behind this design choice is that two base cylinders of equal diameter, having equal tangential speed and rotating with opposite angular speeds, roll on each other without sliding, resulting in less heat or energy dispersion.

Moreover, a reduction in the lateral screw external diameter Øle with respect to the lateral screw internal diameter Øci, in addition to causing a rolling with sliding with consequent wear and loss of efficiency, would not bring any advantage since there would be a decrease in the empty cross-sectional area within which the working fluid is trapped, i.e. a decrease in the pump capacity. Conversely, the increase in the lateral screw external diameter $Ø_{le}$ with respect to the lateral screw internal diameter $Ø_{ci}$ seemed impossible in the prior art studies, since it leads to an interpenetration of the helicoidal profiles generated during the rotation of the screws.

Therefore, having chosen the above equal diameters, in the prior art the flank of the central screw and of the lateral screw is obtained by applying the epitrochoid equations, the epitrochoid being a roulette curve which is obtained by joining the points described in space from a fixed point at a distance p from the center of a circle of radius r by rolling said circle outside another circle of radius $r_b$. The epitrochoid defines the cross-sectional profile of the flanks of the respective screws; by moving forward along the rotational axis of the screw, the profile rotates continuously so as to define a helix.

The known parametric equations of the epitrochoid are the following:

$$x(\vartheta) = (R + r)\cos\vartheta - d\cos\left(\frac{R + r}{r}\vartheta\right)$$

$$y(\vartheta) = (R + r)\sin\vartheta - d\sin\left(\frac{R + r}{r}\vartheta\right)$$

The polar equation is instead the following:

$$r(\vartheta)^2 = (R + r)^2 - 2d(R + r)\cos\left(\frac{R}{r}\vartheta\right) + d^2$$

In FIG. 5, relating to the prior art, $R_1$ and $d_1$ indicate the parameters relating to the construction of the central screw flank, whereas $R_2$ and $d_2$ indicate the parameters relating to the construction of the lateral screw flank. For the considerations previously made, the base radius r is the same for both constructions. As it can be seen, specifically the radii $R_1$ and $R_2$ of the rotating circle are also equal to r for both constructions. Furthermore, in the construction of the central screw flank, the tracing point lies at the end of the radius $r_1$ of the rotating circle, and the resulting curve is called epicycloid.

Therefore, the only design parameter to be set remains the distance from the center of point $d_2$, that draws the lateral screw flank and that determines the central screw external diameter and the lateral screw internal one, respectively. The choice of this parameter aims at optimizing the capacity, i.e. the volume of the screw occupied by the fluid, without affecting the mechanical strength of the screws.

In concrete terms, the typical ratio 1:3:3:5 between the screw diameters is obtained by choosing a value of $d_2$ equal to ⅔ $d_1$, for example by choosing the following parameters:

$R_1=R_2=1.5$ $r=1.5$ $d_2=2.5$ (which generates the driven screw flank)

$d_1=1.5$ (which generates the lead screw, or drive screw, flank)

Since these profiles are homothetic, once this basic relationship has been created with a simple scale effect, it is possible to obtain profiles of any size.

It should be noted that the ideal profiles generated with the epitrochoid equations have sharp edges. Said edges are easily deformable. Possible deformations on the edges risk to promote noise and anomalous vibrations during the pump operation, or even to irreparably damage the pump itself. Moreover, the edges are difficult to make with tool precision, and the consequent shape errors that can be generated locally lead to unwanted difficulties in the screws meshing.

For the reasons mentioned above, in the prior art the ideal profiles are generally modified by beveling the aforementioned sharp edges, in particular on the driven screw which has sharper and potentially more critical edges. The bevel can be carried out in a simple manner by cutting the edge with a straight line, or in a more refined manner with circular arc or elliptical arc-shaped connecting profiles. The latter solution is the one that minimizes leaks or volumetric losses.

Obviously, by introducing the above-described geometric corrections, the perfect conjugation on the line of the screws flanks is lost, therefore it is necessary to completely recalculate the profile for both the driven and the drive screws.

Triple screw pumps according to the prior art are disclosed, for instance, by documents U.S. Pat. No. 3,814,557 A and US 2012/258000 A1.

It should be once again noted that the triple screw pump, as described in this chapter relating to the prior art, was born in the early 1900s, and that the screws' profile has remained substantially unchanged up to date.

The improvements introduced so far have always involved structural or material changes.

On the other hand, there is always a need for improvements on such widespread machines, in particular with regard to the increase in capacity and the reduction of radial and axial dimensions.

The technical problem of the present invention is therefore that of providing a screw assembly and a corresponding triple screw pump with significantly greater flow rate than the prior art pumps of similar size.

SUMMARY OF THE INVENTION

The solution idea underlying the present invention is to provide a screw assembly and a corresponding triple screw pump by relaxing the condition of equality between lateral screw external diameter and lateral screw internal diameter.

If from a purely theoretical point of view the above condition is necessary since it ensures that there is no sliding between the two cylinders consisting of the lateral screw internal diameter and the lateral screw external one, it has been verified that in practice the diameters are not really in contact. On the one hand, the clearances inevitably present to allow the operation of the pump must be considered; on the other hand, it has been verified that the forces exchanged between the screws during the transmission of motion cause reactions that move the two surfaces theoretically in contact away from each other, according to a resultant force $F_{ris}$ identified for instance in FIG. 14.

On the other hand, there is also a second reason why in the prior art the aforementioned diameters are kept equal to each other. As discussed in the previous chapter, the only advantageous change in the diameters in terms of overall capacity is the increase of the lateral screw external diameter $Ø_{le}$ with respect to the lateral screw internal diameter $Ø_{ci}$: this change was however considered impossible, because it would have led to interpenetration between the profiles of the screws.

However, it was observed that this theoretical perspective did not take into due consideration the changes to the profiles actually introduced at the time of processing, in particular the bevels made at the sharp edges of the profiles. These geometric corrections, made precisely where interpenetration would have occurred, lie within the pitch diameter that generated the edge. For this reason, the theoretical interpenetration can be avoided in practice by exploiting the technological need for edge beveling.

The relaxation of the equality condition has led to a totally new design perspective, which has allowed reconsidering the consolidated profile in the prior art, thus obtaining a greater area of fluid trapping, and ultimately increasing the flow rate with the same external diameter of the screws.

In the present invention, the relaxation of the equality condition between the diameters has been achieved, taking into consideration the different parameters that influence the definition of the profile. First of all, the clearance necessary for the set of three screws for a correct rolling was considered. The maximum extent of the corrections that can be made to the theoretical formulas was therefore verified, in order not to create imbalances on the profile that would have generated fluid leaks. Finally, the minimum internal diameter achievable on the lateral screw was evaluated from a technological point of view, considering the workability of the piece by machine tools and the mechanical strength of the piece itself.

The above exposed technical problem is thus solved by a screw assembly for a triple screw pump, comprising: a central screw having one or more threads with constant pitch and two lateral screws configured to mesh with said central screw, each with a lateral screw axis parallel to a central screw axis, wherein a central screw external diameter is greater than a lateral screws external diameter, wherein a central screw internal diameter is smaller than the lateral screws external diameter, and by a respective triple screw pump comprising a pump body, a suction port, a discharge port and a screw assembly as described directly above, wherein the lateral screws are equal to each other and configured to mesh at two sides of the central screw with the lateral screw axis parallel to the central screw axis, wherein the central screw and the lateral screws are arranged in a rotating manner and intermeshed within the pump body, the rotation of said central and lateral screws moving a fluid from the suction port to the discharge port.

Therefore, there is a screw assembly for triple screw pump, comprising: a central screw and at least one lateral screw arranged to mesh with said central screw with the lateral screw axis parallel to the central screw axis, wherein a central screw internal diameter is greater than a lateral screw external diameter, characterized in that a lateral screw internal diameter is smaller than a lateral screw external diameter. Both screws comprise one or more helicoidal threads having constant pitch.

The lateral screw internal diameter is preferably comprised between 60% and 99% of the lateral screw external diameter, more preferably between 68% and 98%, even more preferably between 85% and 92%.

Preferably, the lateral screw internal diameter is smaller than the diameter of the respective pitch circle and the lateral screw external diameter is greater than the diameter of the respective pitch circle.

Preferably, the lateral screw external diameter is comprised between 1 time and 1.3 times the diameter of the respective pitch circle, more preferably it is comprised between 1 time and 1.2 times, even more preferably the lateral screw external diameter is equal to 1.1 times the diameter of the respective pitch circle.

Preferably, the distance between the axes of the central screw and of the lateral screw is greater than the half and lower than ⅗ of a central screw external diameter.

The distance between the axes of the central screw and the lateral screw is preferably comprised between 52% and 56% of the central screw external diameter, and still more preferably equal to 54%.

The features and advantages of the gear wheel and of the apparatus of the present invention will become apparent from the following description of an embodiment thereof given by way of non-limiting example with reference to the appended drawings.

DETAILED DESCRIPTION

Figure 1:
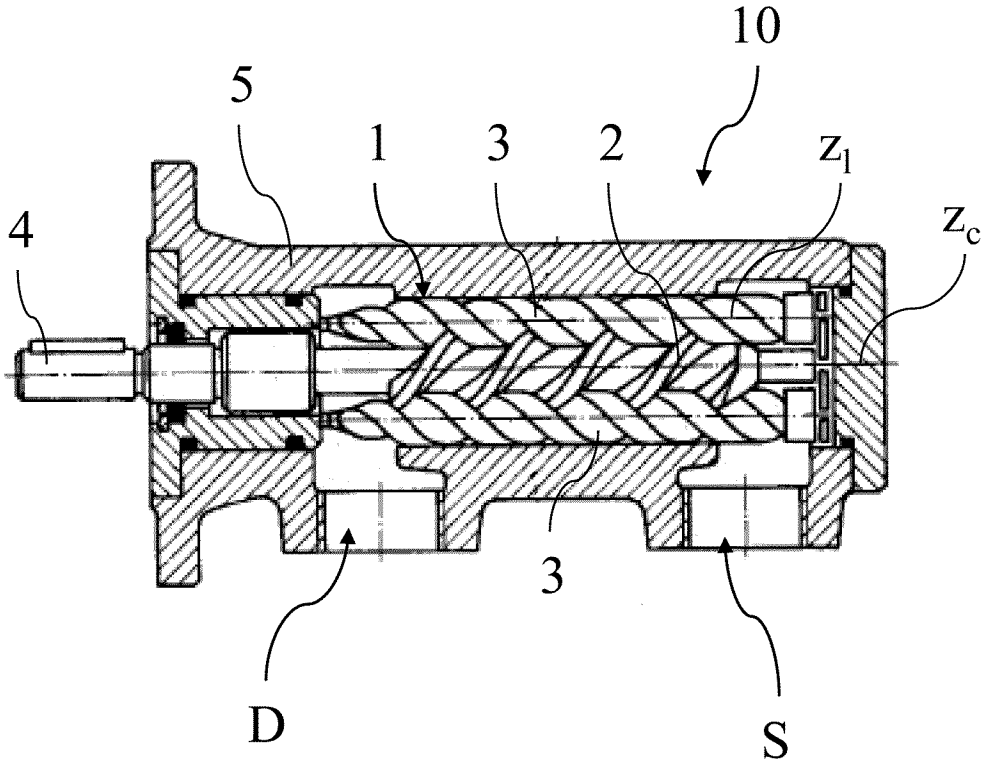
FIG. 1 schematically shows a triple screw pump which can feature the screw assembly according to the invention.
Figure 3:
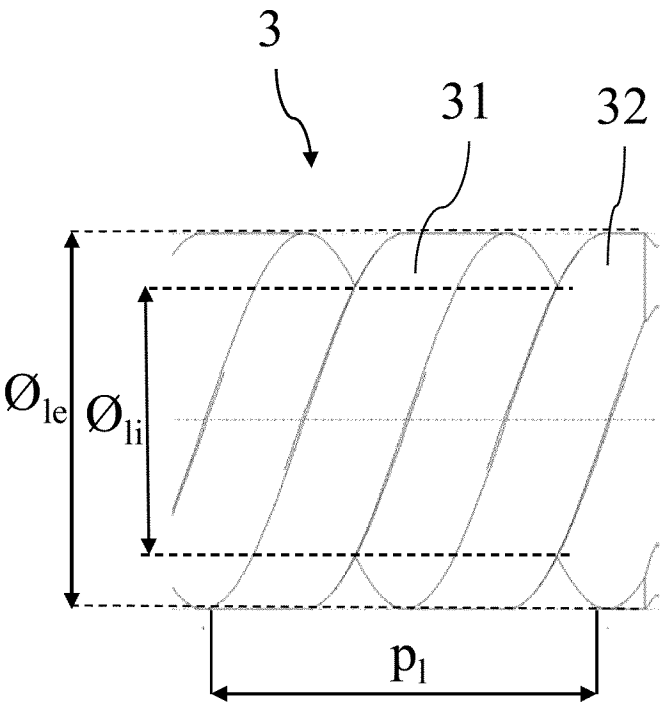
FIG. 3 schematically shows, in a side view, a portion of the central screw of the screw assembly according to the invention.
Figure 2:
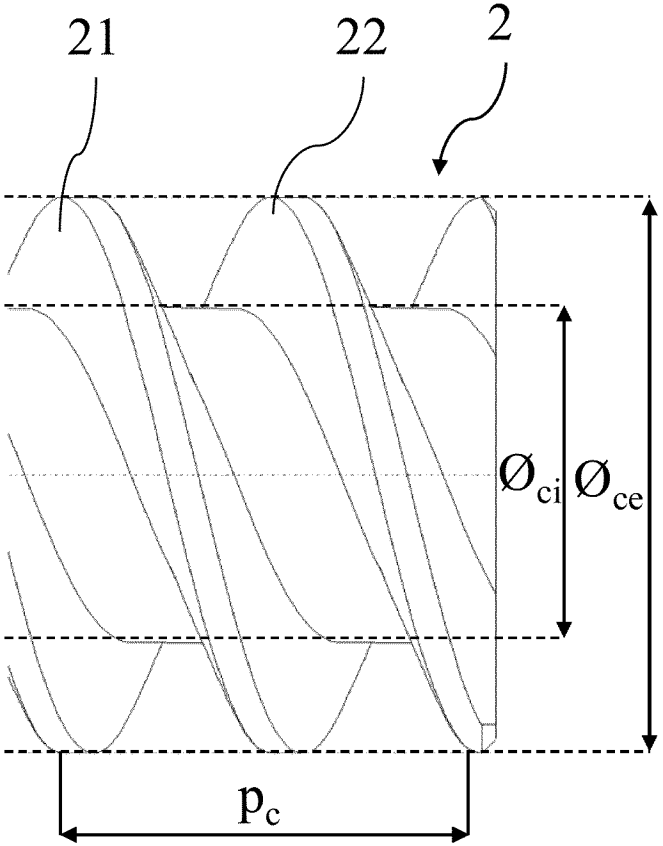
FIG. 2 schematically shows, in a side view, a portion of the central screw of the screw assembly according to the invention.

With reference to the above FIG. 1, a triple screw pump is globally indicated with reference number 10, whereas reference number 1 indicates the screw assembly 2, 3 assembled thereon. As previously described, the present invention specifically relates to the profiles 20, 30 of said screws 2, 3, which in FIGS. 10-13 faces a corresponding profile 20', 30' of the prior art. The new profiles 20, 30 define, in cross-section, a supplementary volume V in which the fluid to be pumped is trapped with respect to the corresponding profiles 20', 30' of the prior art.

It is worth noting that the figures represent schematic views and are not drawn to scale, but instead they are drawn so as to enhance the important features of the invention. Furthermore, in the figures, the different elements are shown schematically since their shape may vary according to the desired application. It is also worth noting that in the figures identical reference numbers refer to elements that are identical in shape or function.

Figure 4:
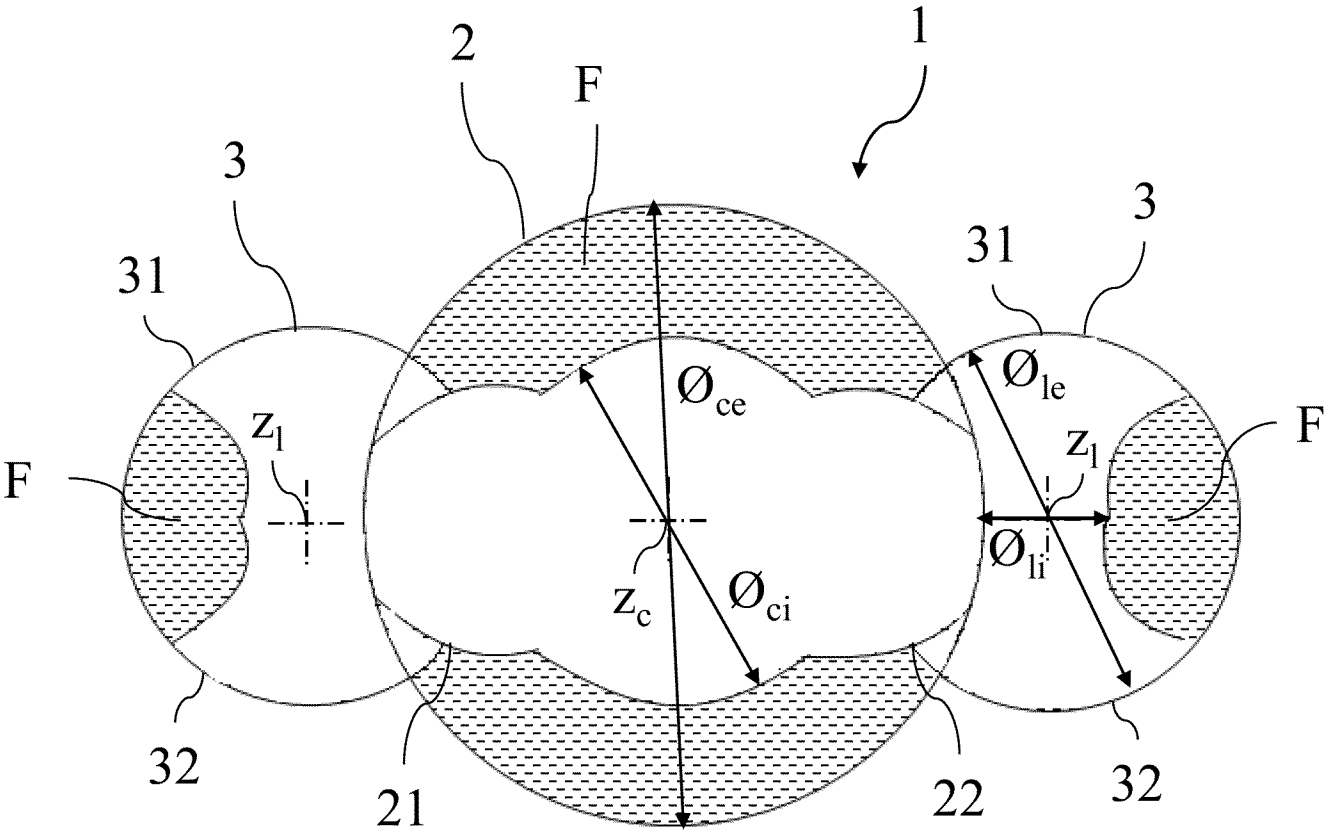
FIG. 4 shows a cross section of the screw assembly according to the present invention in an operational configuration, with the fluid trapping areas identified by mesh portions.

In a known manner, the triple screw pump 10 comprises a pump body 5 with a suction port S and a discharge port D. Within the pump body a screw assembly 1 is assembled with a lead central screw 2, integral with a driving shaft 4, and two driven lateral screws 3. The axes $z_l$ of the lateral screws 3 and the axis $z_c$ of the central screw 2 are parallel to each other and the screws mesh with each other. The rotation movement of the central screw 2 thus moves the two lateral screws 3 and carries a fluid F from the suction port S to the discharge port D in the spaces enclosed between the opposite threads, as illustrated in FIG. 4.

The central screw 2 has two threads 21, 22 with fixed pitch $p_c$; the lateral screws 3 also have two threads with pitch $p_l$ equal to that of the central screw 2.

The profile 20 of the central screw 2 thus has in cross-section two circular crest portions, joined to the cylindrical bottom by noticeably convex flanks.

The profile 30 of the lateral screw 3 also has in cross section two circular crest portions, joined to the cylindrical bottom by noticeably concave flanks.

It is noticed that, in a known manner, the two lateral screws 3 are equal to each other or have the same profile 30.

As above mentioned, the present invention relates to the specific shape of the profiles 20, 30 of the flanks of the screws 2, 3.

The preferred embodiment herein described shows a preferred shape of said profiles, showing how this is obtained from the prior art profiles.

Figure 5:
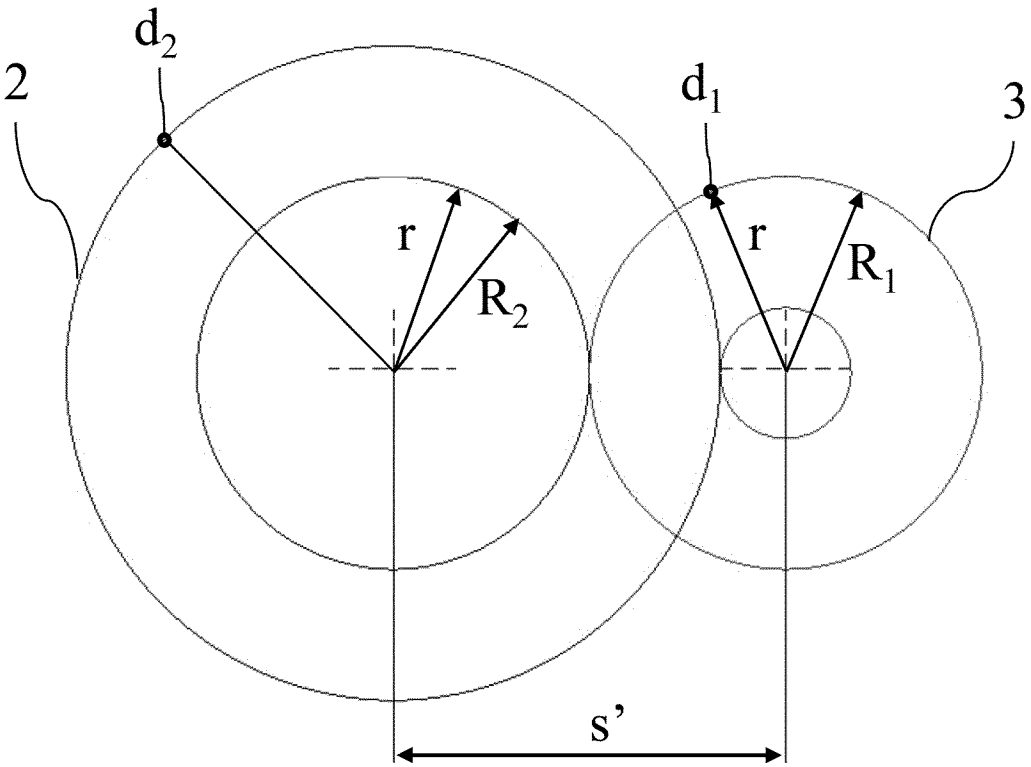
FIG. 5 shows a diagram relating to the generation of screw profiles in a triple screw pump of the prior art.

As described in the corresponding paragraph of the present disclosure, the prior art profiles are made from an equivalence condition between lateral screw internal diameter and lateral screw external diameter. Thus, as shown in FIG. 5, there is a distance between the axes s' equal to the lateral screw 2 internal diameter, i.e. to the lateral screw 3 external diameter. Moreover, in the prior art the lateral screw internal diameter is equal to ⅓ of the respective external diameter, and the central screw external diameter is equal to ⅔ of the internal diameter. Therefore, there is the typical ratio between diameters 1:3:3:5.

Figure 6:
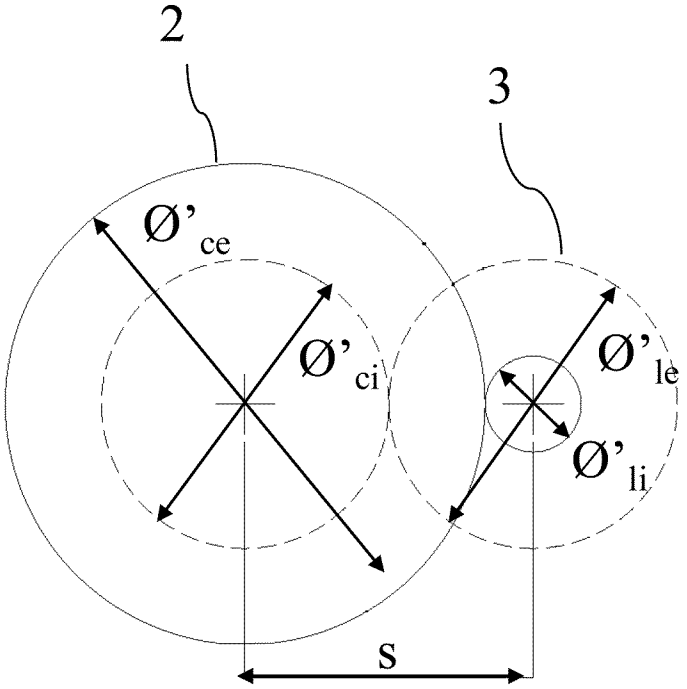
FIG. 6 shows a first step of a conceptual procedure for generating the flank profile in a screw assembly according to the present invention.

To obtain the new profiles, first of all the above mentioned ratio is modified, identifying a new parameterization that allows increasing the capacity of the pump without compromising the mechanical resistance of the screws. This new ratio between diameters $Ø'_{li}:Ø'_{le}:Ø'_{ci}:Ø'_{ce}$, illustrated in FIG. 6, is conveniently chosen as 0.4:2.7:2.7:5, and allows increasing the suction section by about 7%. Following the proposed parameterizations with respect to the diameters, with respect to the prior art the new distance between the axes S has thus been reduced from the value of 3 to the value of 2.7.

Starting from the new parameters, ideal profiles for the two screws are generated by using the epitrochoid equations as described in the prior art analysis. As previously described, the epitrochoid is the curve obtained by joining the points described in space from a fixed point at a certain distance from the center of a radius circle by rolling said circle outside another circle: the distance from the circle and the radius of the circles are determined in this case by the internal and external diameters chosen for the two screws. The epitrochoid is externally and internally joined to the circles defined by the internal and external diameters chosen for both screws, thus determining the ideal profiles visible in FIG. 7.

The other parameter to be determined is the starting point p, p', p" for the epitrochoid generation. Actually, the parameter that characterizes the screws is the angle α subtended by the chord that joins two successive starting points p', p" of the epitrochoids that generate the profile on the central screw 2: said value is uniquely linked to the corresponding angle β on the other screw 3. Said angles, hereinafter defined tooth opening angle α and flank opening angle β, define the length of the arc of circle that joins the flanks on the external profile of the central screw 2 and the length of the arc of circle between two successive teeth of the lateral screw 3. On the one hand they determine the cylindrical surface in sliding contact with the housing of the screws, on the other hand the mechanical strength of the helix defined on the screw. The applicant has determined, through geometric analyzes, that the useful volume for trapping the working fluid is an invariant with respect to the choice of the opening angles of the tooth a and of the flank B. For this reason, the angles may be selected at will just based on tribological and mechanical considerations, without impacting the capacity of the pump.

Figure 8:
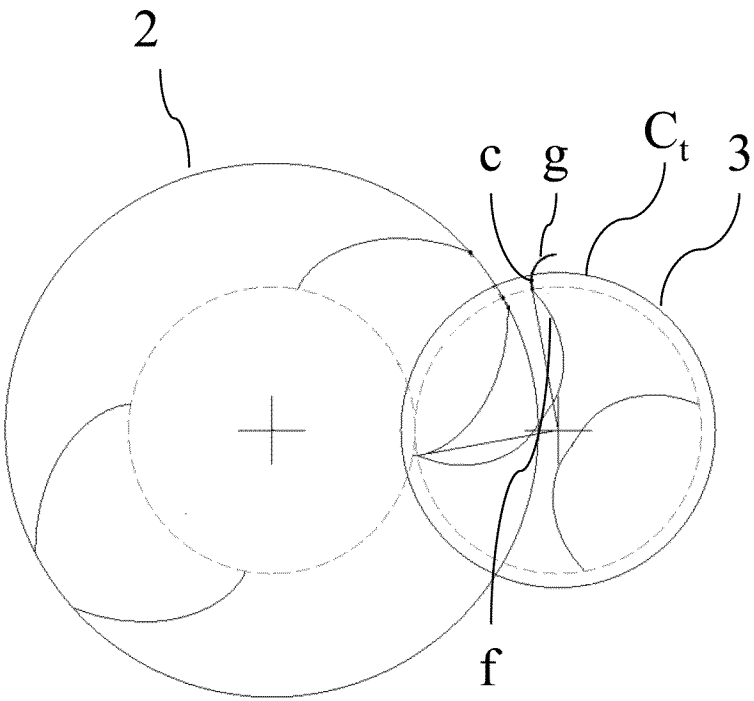
FIG. 8 shows a third step of a conceptual procedure for generating the flank profile in a screw assembly according to the present invention.
Figure 11:
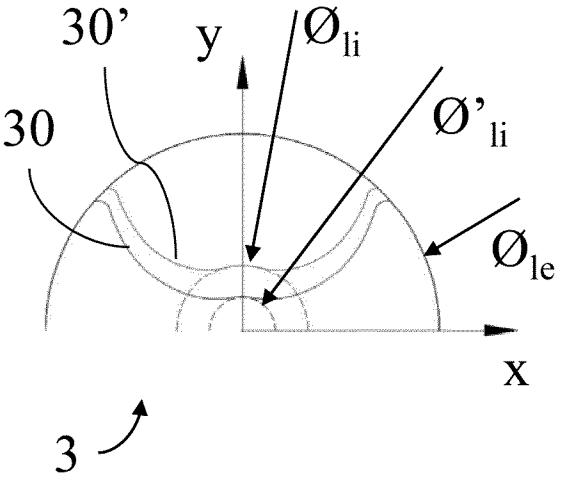
FIG. 11 compares the profile of a lateral screw according to the present invention with the profile of a lateral screw according to the prior art.
Figure 10:
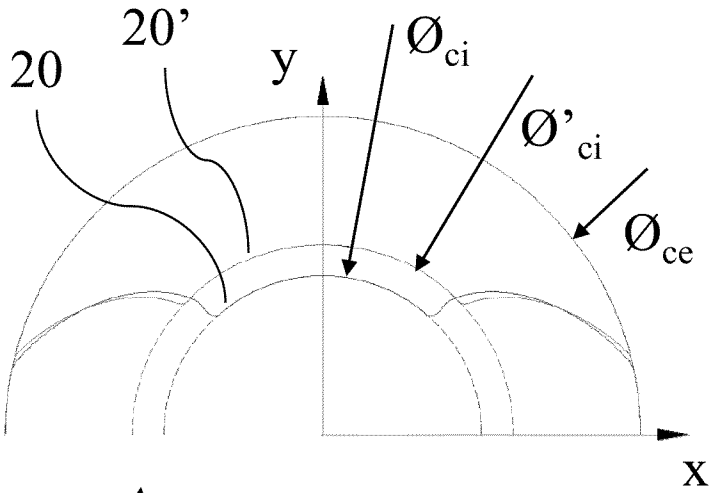
FIG. 10 compares the profile of a central screw according to the present invention with the profile of a central screw according to the prior art.

Then the application of an additional geometry g above the ideal profile of the driven lateral screw 3 is carried out. Said additional geometry g, represented in FIG. 8, develops outside the pitch diameter, and joins the flank f defined by the epitrochoid equation to a truncation circle $C_t$, of diameter greater than the lateral screw external diameter $Ø'_{le}$ previously set, i.e. of a diameter greater than the pitch circle diameter $C_{pl}$. The additional geometry g thus defines a face c of the screw profile, which joins to the flank in the previously identified point p. The connection point p between the face c defined by the epitrochoid and the flank f defined by the additional geometry will preferably be an inflexion point, not an angular point (wherein by angular point a non-differentiable point of the first kind is intended). The additional geometry g can be suitably selected according to the design choices, for example it can be an elliptical curve or a spline function.

Figure 9:
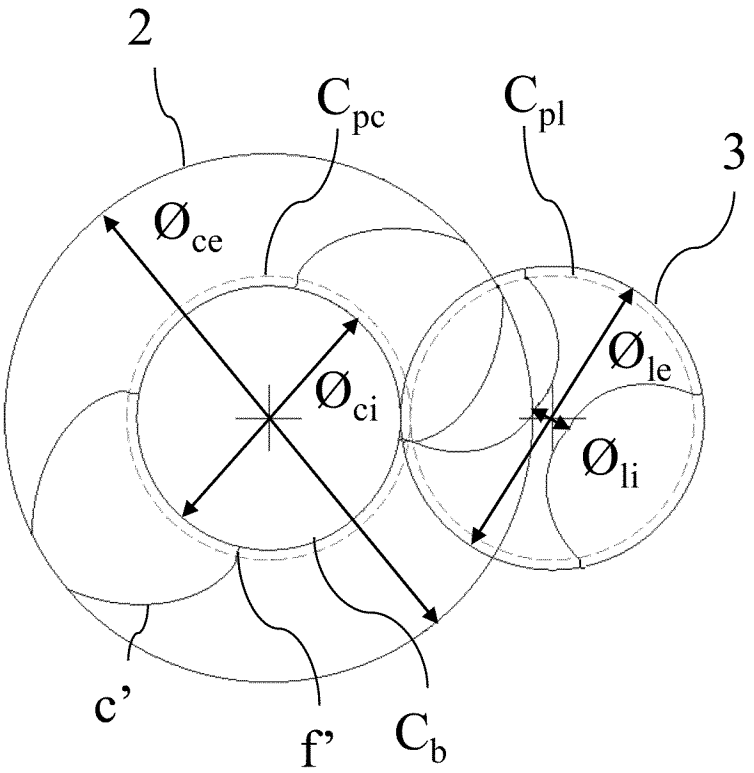
FIG. 9 shows a fourth step of a conceptual procedure for generating the flank profile in a screw assembly according to the present invention.

Once obtained the final profile of the lateral screw 3, the profile of the central screw 2 is obtained by interpolation. The two final profiles are illustrated in FIG. 9. As it may be noticed, at the base of face c' of the central screw 2 defined by the epitrochoid a connection flank f' to a new internal circle with respect to the pitch circle $C_{pc}$ develops. The redefinition of the profiles thus leads to a variation of the internal and external diameters of the two screws. In particular, the lateral screw internal diameter $Ø_{ci}$ is now smaller than the lateral screw external diameter $Ø_{le}$. The ratio between the final diameters $Ø_{li}:Ø_{le}:Ø_{ci}:Ø_{ce}$, by using the previous parametrization, is now 0.4:2.97:2.43:5.

Figure 7:
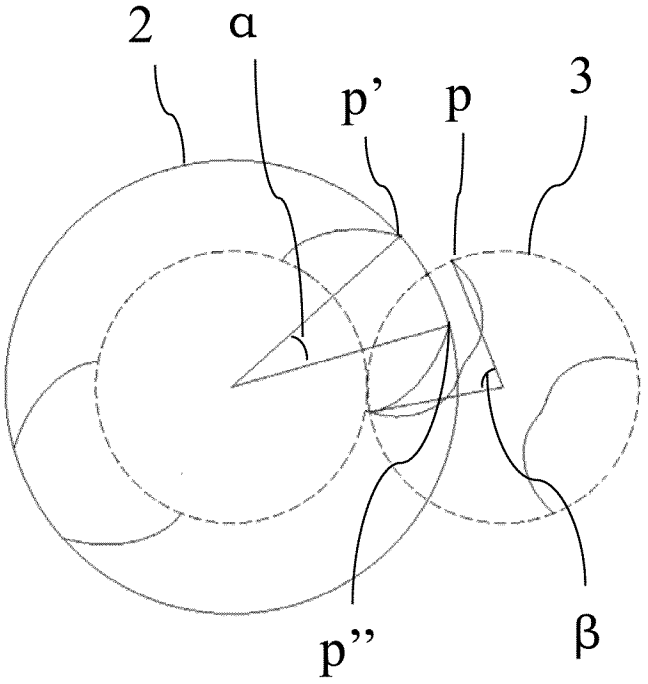
FIG. 7 shows a second step of a conceptual procedure for generating the flank profile in a screw assembly according to the present invention.

The modification made with respect to the ideal profiles illustrated in FIG. 7 leads to a further increase in the pump capacity for the same diameter of the screws equal to about 10%. The increase in the overall capacity compared to the prior art is therefore equal to about 17%. In addition, the radial dimensions of the pump decrease due to the reduction in the distance between the axes of the screws.

Figure 13:
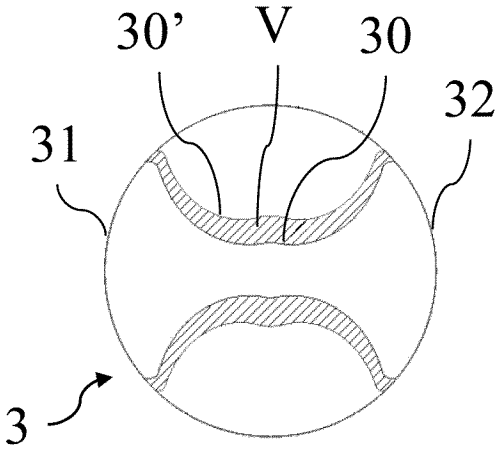
FIG. 13 compares the profile of a lateral screw according to the present invention with the profile of a lateral screw according to the prior art, with the supplementary fluid trapping area identified by a hatched portion.
Figure 12:
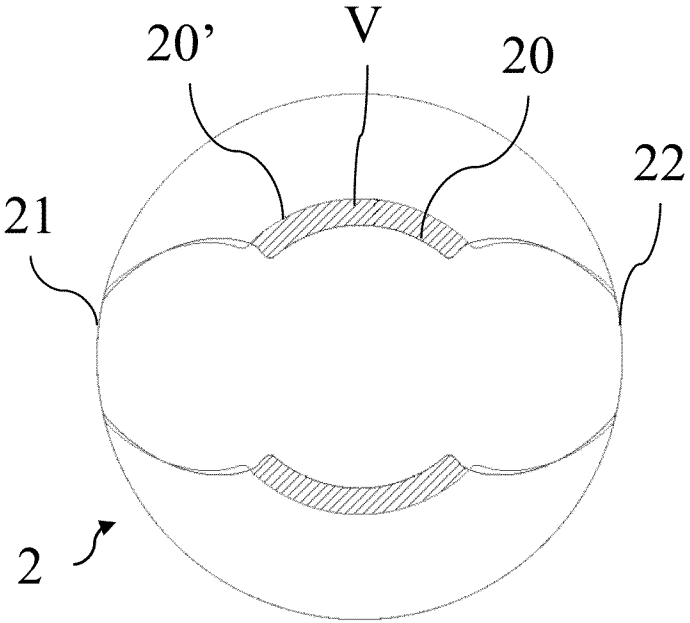
FIG. 12 compares the profile of a central screw according to the present invention with the profile of a central screw according to the prior art, with the supplementary fluid trapping area identified by a hatched portion.
Figure 14:
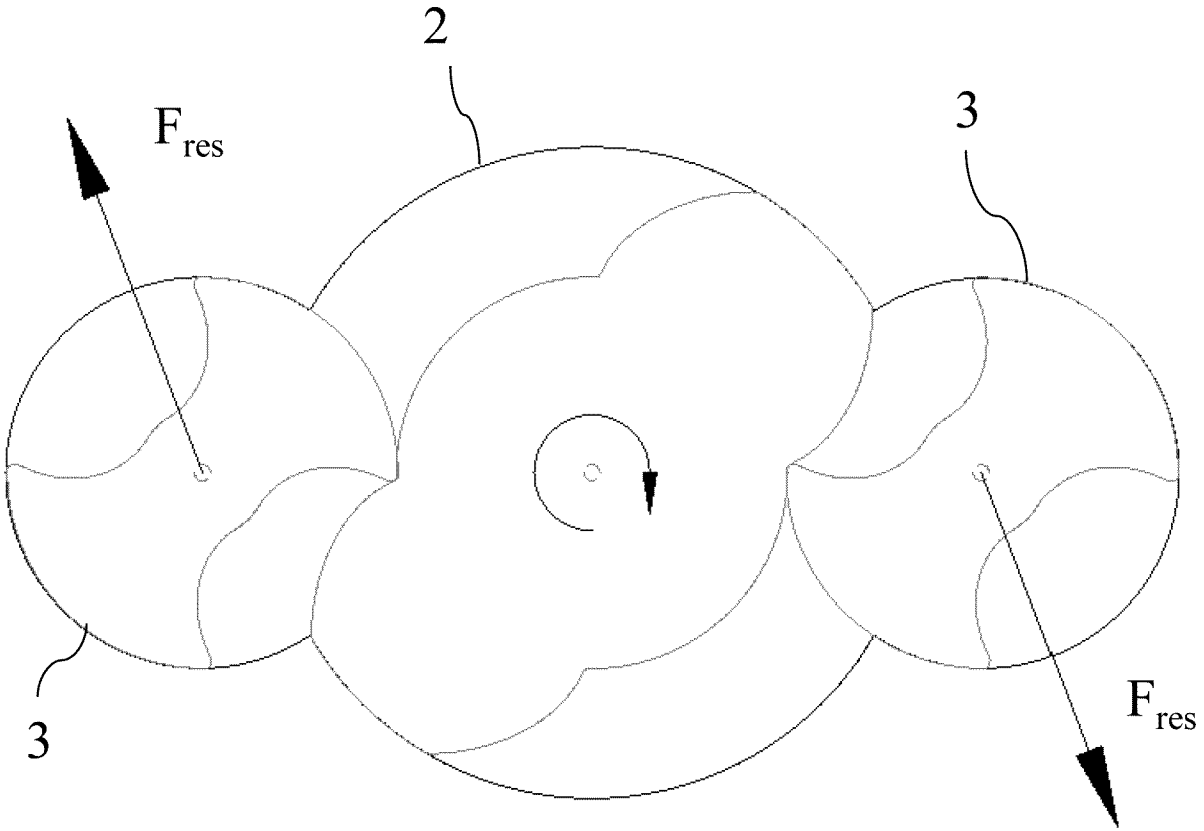
FIG. 14 illustrates the forces acting on the rotors driven in a generic triple screw pump.

The above described improvement can be clearly seen in FIGS. 12, 13; in fact, the hatched area represents an increase in the free frontal volume that can be occupied by the pumped fluid with a consequent capacity increase with the same external diameters of the screws.

An advantage of the pump according to the present invention results from the particularly compact dimensions, in particular in the radial direction, but also in the axial direction since with the same flow rate the pitch of the screws will be shorter.

A further advantage comes from the lower amount of material required for the construction of the pump, which results in limited production costs.

Other advantages of the pump according to the present invention relate to its performance features. In particular, the pump has the same volumetric efficiency but a better pressure ripple, a reduced noise, and a lower net positive suction head (NPSH).

Obviously, a skilled person can make several changes and variants to the above described gear wheel and the apparatus, in order to meet contingent and specific needs, all of them by the way contained in the scope of protection of the invention as defined by the following claims.

What is claimed is:

1. A screw assembly for a triple screw pump, comprising: a central screw having one or more threads with constant pitch and two lateral screws configured to mesh with said central screw, each with a lateral screw axis parallel to a central screw axis, wherein a central screw external diameter is greater than a lateral screws external diameter, wherein a central screw internal diameter is smaller than the lateral screws external diameter; wherein a cross-sectional profile of the lateral screws has a flank which follows an epitrochoid, said flank being joined to a truncation circle by a face; wherein the flank and the face connect in an inflexion point on the cross-sectional profile of the lateral screws.

2. The screw assembly according to claim 1, wherein the central screw internal diameter is comprised between 60% and 99% of the lateral screws external diameter.

3. The screw assembly according to claim 2, wherein the central screw internal diameter is comprised between 85% and 92% of the lateral screws external diameter.

4. The screw assembly according to claim 1, wherein the central screw internal diameter is smaller than a diameter of a central screw pitch circle and the lateral screws external diameter is greater than a diameter of lateral screws pitch circle.

5. The screw assembly according to claim 4, wherein the lateral screws external diameter is comprised between 1 time and 1.3 times the diameter of the lateral screws pitch circle.

6. The screw assembly according to claim 5, wherein the lateral screws external diameter is equal to 1.1 times a diameter of the lateral screws pitch circle.

7. The screw assembly according to claim 1. wherein said face of the lateral screws is curvilinear and joined to the flank and the truncation circle without angular points (non-differentiable point of the first kind).

8. The screw assembly according to claim 1, wherein a cross-sectional profile of the central screw has a face which follows an epitrochoid, said face being joined to a base circle by a flank.

9. The screw assembly according to claim 1, wherein a distance between the central screw axis and the lateral screws axis is greater than ½ and smaller than ⅗ of the central screw external diameter.

10. The screw assembly according to claim 9, wherein a distance between the central screw axis and the lateral screws axis is comprised between 52% and 56% of the central screw external diameter.

11. The screw assembly according to claim 10, wherein the distance between the central screw axis and the lateral screws axis is equal to 54% of the external diameter of the central screw.

12. The screw assembly according to claim 1, wherein the lateral screws are equal to each other and configured to mesh at two sides of the central screw with the lateral screw axis parallel to the central screw axis.

13. The screw assembly according to claim 12, wherein the central screw comprises a first thread and a second thread having an equal pitch, and both lateral screws comprise a first thread and a second thread having equal pitch, the pitch of the central screw threads being equal to the pitch of the lateral screws threads.

14. A triple screw pump comprising a pump body, a suction port, a discharge port and a screw assembly according to claim 12, wherein the main central screw and the lateral screws are arranged in a rotating manner and intermeshed within the pump body, the rotation of said main central and lateral screws moving a fluid from the suction port to the discharge port.

15. A screw assembly for a triple screw pump, comprising: a central screw having one or more threads with constant pitch and two lateral screws configured to mesh with said central screw, each with a lateral screw axis parallel to a central screw axis, wherein a central screw external diameter is greater than a lateral screws external diameter, wherein a central screw internal diameter is smaller than the lateral screws external diameter; wherein a cross-sectional profile of the lateral screws has a flank which follows an epitrochoid, said flank being joined to a truncation circle by a face; wherein said face of the lateral screws is curvilinear and joined to the flank and the truncation circle without angular points (non-differentiable point of the first kind).

* * * * *